US005718843A

United States Patent [19]

Chang

[11] Patent Number: 5,718,843

[45] Date of Patent: Feb. 17, 1998

[54] COMPOSITION OF ELECTRIC BEAM FOR SPARK PLUG AND CABLE

[76] Inventor: Tzu-Lung Chang, 4F, No. 19, Charng Shing Rd., Tsu Keng Sub-Ward, Hsintien Taipei Hsien, Taiwan

[21] Appl. No.: 766,041

[22] Filed: Dec. 16, 1996

[51] Int. Cl.[6] ..... H01B 1/24; H01B 1/18

[52] U.S. Cl. ..... 252/509; 252/510; 252/511

[58] Field of Search ..... 252/509, 510, 252/511

[56] References Cited

U.S. PATENT DOCUMENTS

| | | | |
|---|---|---|---|
| 2,042,679 | 6/1936 | Murray et al. | 106/22 |
| 2,106,578 | 1/1938 | Schwartzwalder et al. | 123/169 |
| 2,351,022 | 6/1944 | Donelson et al. | 106/106 |
| 3,909,459 | 9/1975 | Friese et al. | 252/509 |
| 4,112,330 | 9/1978 | Stimson et al. | 315/46 |
| 4,197,218 | 4/1980 | McKaveney | 252/503 |
| 4,539,357 | 9/1985 | Bobear | 524/267 |
| 4,601,848 | 7/1986 | Sakai et al. | 252/503 |
| 4,780,432 | 10/1988 | Minford et al. | 501/32 |
| 5,399,295 | 3/1995 | Gamble et al. | 252/511 |

*Primary Examiner*—Douglas J. McGinty

*Attorney, Agent, or Firm*—Morton J. Rosenberg; David I. Klein; Jun Y. Lee

[57] ABSTRACT

A composition of electric beam for spark plug and cable is provided which is consisted of carbon, Magnesium Oxide (MGO), and binder with suitable percentage in weight. The electric beam can be disposed between the center electrode and, the spark plug terminal. Since the electric beam comprises Magnesium Oxide (MGO) and carbon, the carbon is an excellent conductive material while the Magnesium Oxide (MGO) is an excellent insulator. Even the Magnesium Oxide (MGO), is an insulator, it has excellent potential capacity of store and excite the electrical charge. Consequently, when the current with high voltage flows over the electric beam, an intensified and concentrated current is generated. As a result, the spark is, stronger as compared to those spark plug without the electric beam. In light of this, when a stronger spark is generated, a complete combustion can be attained, i.e.—higher output of power can be attained.

1 Claim, 2 Drawing Sheets

COMPOSITION OF ELECTRIC BEAM FOR SPARK PLUG AND CABLE

FIELD OF THE INVENTION

This invention relates to a composition of electric beam for spark plug and cable, more particularly, to a composition of electric beam used on the center electrode of the spark-plug or electric wire which sustain high voltage.

DESCRIPTION OF PRIOR ART

The spark-plug plays a great and important role in the output of engine's power. The spark-plug is requested to generate a high-voltage spark to ignite the air/fuel mixture inside the combustion chamber. Consequently, the burned gases will generate a downward force to push, the cylinder, and the crank shaft linked thereof will translate this linear movement into the rotative movement. Normally, the higher the operating voltage, the stronger the spark can be generated. Nevertheless, it is difficult to increase the spark generated by the existed spark-plug. Consequently, the output of the engine power can not be increased by increasing the operating voltage of the spark-plug.

Accordingly, there is still a room for providing a spark-plug which may generate a comparatively stronger spark.

SUMMARY OF THE INVENTION

It is the object of this invention to provide a composition wherein the electric beam can be used on the center electrode of a spark-plug, consequently, a stronger spark can be generated.

According to the preferred embodiment of the present invention, the composition consisted of the following substances: 1) 25%–75% of carbon powder by percentage in weight; 2) 5%–75% of Magnesium Oxide (MGO) by percentage in weight; and 3) 4%–6% of binder by percentage in weight. The electric beam can be disposed between the center electrode and the spark plug terminal, Since the electric beam comprises Magnesium Oxide (MGO) and carbon, the carbon is an excellent conductive material while the Magnesium Oxide (MGO) is an excellent insulator. Even the Magnesium Oxide (MGO) is an insulator, it has excellent potential capacity of store and excite the electrical charge. Consequently, when the current with high voltage flows over the electric beam, a concentrated current is generated. As a result, the spark is stronger as compared to those spark plug Without the electric beam. By this arrangement, when a stronger spark is generated, a complete combustion can be attained, i.e. higher output of power can be attained. Besides, this 20 electric beam can be applied to the spark plug cable.

BRIEF DESCRIPTION OF THE DRAWINGS

In order that the present invention may more readily be understood the following description is given, merely by way of example with reference to the accompanying drawings, in which.

BRIEF DESCRIPTION OF NUMERALS

| | |
|---|---|
| 1 spark plug | 10 center electrode |
| 11 electric beam | 12 spark plug terminal |
| 2 spark plug cable | 20 cap |

DETAILED DESCRIPTION OF PREFERRED EMBODIMENT

The present invention relates to a composition of electric beam, consists the substances of:

1) 25%–75% of carbon powder by percentage in weight, wherein the carbon is an excellent conducting material;

2) 5%–75% of Magnesium Oxide (MGO) by percentage in weight, wherein the Magnesium Oxide (MGO) is an excellent material for current concentrating; and 3) 4%–6% of binder by percentage in weight wherein the binder includes suitable resin material.

The carbon powder in (a) is mixed with the Magnesium Oxide (MGO) in (b), then the binder in (c) is introduced to cure the mixture. At last the resulted material can be used as a electric beam on both spark plug and spark plug cable.

At present, the terminology of "light beam", "fire plasma", "water streamline", and "air streamline" mean the energy resource can be concentrated to attain an intensive result. The electric beam is resulted from this principle, i.e. the current is condensed and concentrated to get a stronger result.

Figure 1:
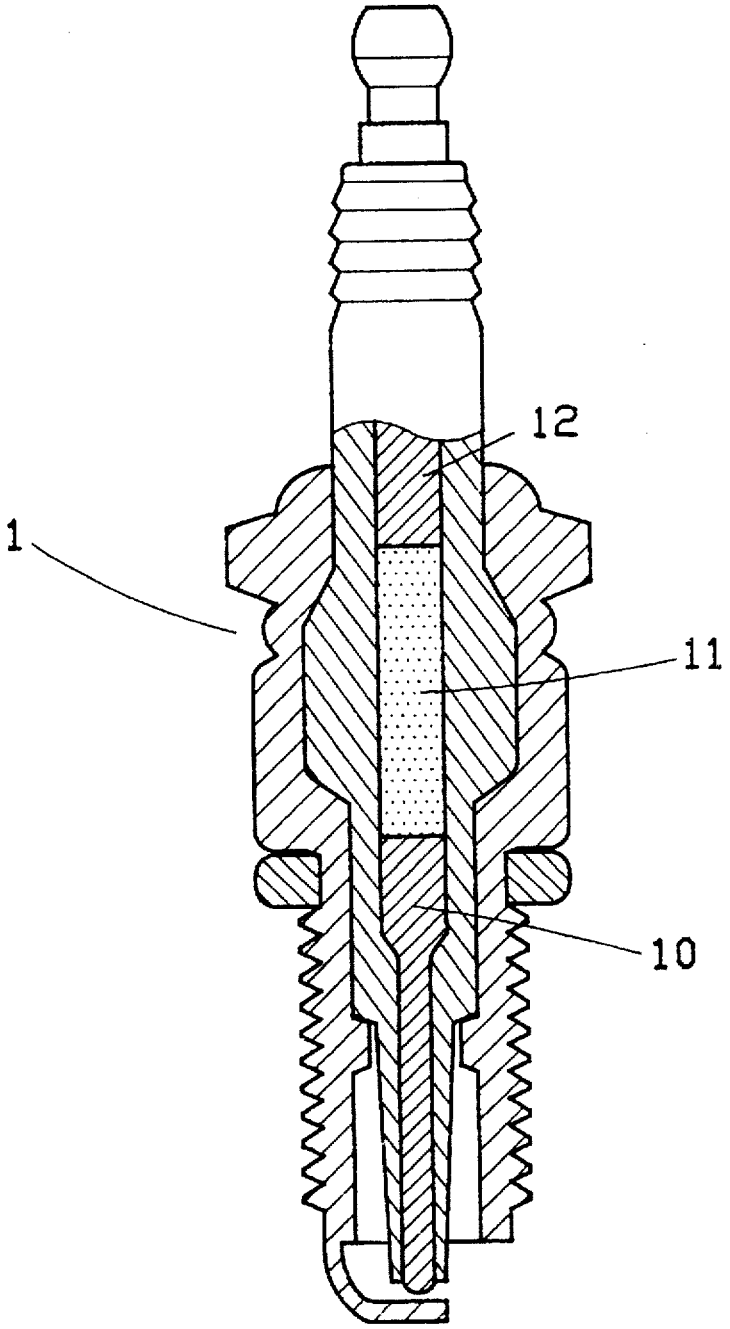
FIG. 1 is a cross sectional view of a spark plug incorporated with the electric beam made according to this invention.

As shown in FIG. 1, the electric beam 11 can be disposed between the center electrode 10 and the spark plug terminal 12. Since the electric beam 11 comprises powders of Magnesium Oxide (MGO) and carbon, the carbon is an excellent conductive material while the Magnesium Oxide (MGO) is an excellent insulator. Even the Magnesium Oxide (MGO) is an insulator, it has excellent potential capacity of store and excite the electrical charge.

When the current flows over the center electrode 10, the electric beam 11, and the spark plug terminal 12, the current is intensified by the electric beam, 11 such that a stronger spark can be attained. The stronger the spark, the more complete of the combustion, i.e. the higher of power can get.

Besides, a plurality of individual electric beams 11 can be disposed respectively between the center electrode 10 and the spark plug terminal 12 of the spark plug 1. Each of the individual electric beam 11 is spaced apart from another electric beam by this arrangement, an enhanced result can be attained.

Figure 2:
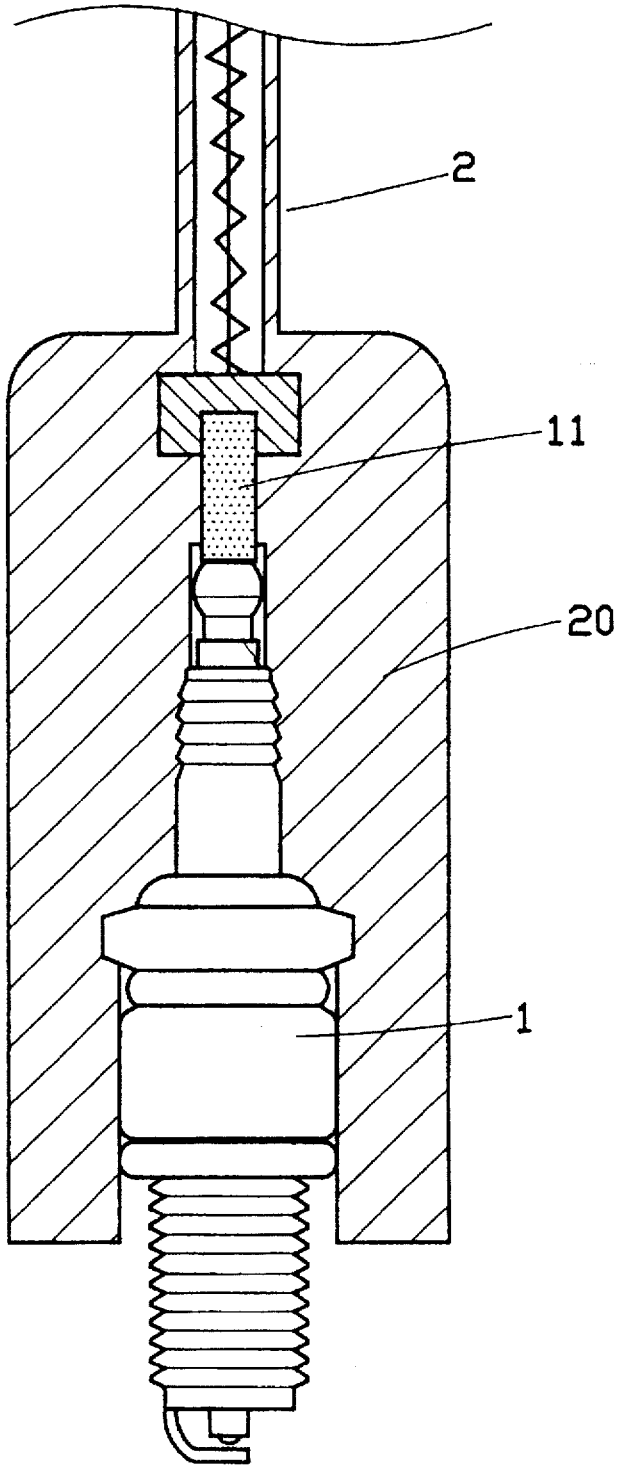
FIG. 2 is still a cross sectional view showing the electric beam is applied on the spark plug cable.

Referring to FIG. 2, the electric beam 11 can be also applied on the spark plug cable 2. In application, the electric beam 11 is disposed within the cap 20 of the spark plug cable 2 such that the electric beam 11 is disposed between the contact of the cap 20 and the spark plug terminal 12 of the spark plug 1. Again the operating current can be intensified such that a stronger spark can be attained on the spark plug 1. The stronger the spark, the more complete of the combustion, i.e. the higher of power can get.

The percentage of the carbon and Magnesium Oxide (MGO) can be varied to meet different requirements. Normally, an intensified and concentrated effect can be attained as the percentage of Magnesium Oxide (MGO) by weight exceeds 10%. Unless otherwise specified, the percentage of Magnesium rarely exceeds 70%.

By the forgoing description, it can be readily appreciated that the spark generated by the spark plug can be intensified and concentrated by the application of electric beam without additional operating voltage. The output of engine's power is increased as well resulted from complete combustion of air/fuel mixture.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A composition of electric beam for spark plug and cable, consisting of:

1) 25%–75% of carbon powder by percentage in weight;

2) 5%–75% of Magnesium Oxide (MGO) by percentage in weight; and 3) 4%–6% of binder by percentage in weight;

the carbon powder in (a) being mixed with the Magnesium Oxide (MGO) in (b), then the binder in (c) being introduced to cure the mixture.

* * * * *